US008960933B2

(12) United States Patent
Guerrieri

(10) Patent No.: US 8,960,933 B2
(45) Date of Patent: Feb. 24, 2015

(54) LED HOUSING

(71) Applicant: Salvatore Guerrieri, New York, NY (US)

(72) Inventor: Salvatore Guerrieri, New York, NY (US)

( * ) Notice: Subject to any disclaimer, the term of this patent is extended or adjusted under 35 U.S.C. 154(b) by 0 days.

(21) Appl. No.: 13/975,576

(22) Filed: Aug. 26, 2013

(65) Prior Publication Data

US 2014/0056005 A1 Feb. 27, 2014

Related U.S. Application Data

(60) Provisional application No. 61/758,674, filed on Jan. 30, 2013, provisional application No. 61/692,856, filed on Aug. 24, 2012.

(51) Int. Cl.
*F21V 9/16* (2006.01)
*F21V 29/00* (2006.01)

(52) U.S. Cl.
CPC ..... *F21V 29/22* (2013.01)
USPC ..... 362/84; 362/249.02; 362/294; 362/373

(58) Field of Classification Search
CPC ..... F21V 29/002; F21V 29/004; F21V 29/20; F21V 29/22; F21V 9/12; F21V 31/00; F21V 31/04; F21Y 2101/02; H01L 25/10; H01L 25/13; H01L 33/02; H01L 33/08; H01L 33/26; H01L 33/48; H01L 33/483; H01L 33/486; H01L 33/501; H01L 33/502; H01L 33/507; H01L 33/52; H01L 33/64
USPC ..... 362/84, 237, 240, 249.02, 800, 249.01, 362/294, 373; 438/26, 28, 29, 11, 121, 122; 257/88, 89, 98, 99, 100, E33.067, 257/E33.068; 313/500, 502, 512
See application file for complete search history.

(56) References Cited

U.S. PATENT DOCUMENTS 8,324,654 B2 * 12/2012 An et al. ..... 257/99
2010/0295070 A1 * 11/2010 Su et al. ..... 257/91

* cited by examiner

*Primary Examiner* — Thomas M Sember

(57) ABSTRACT

An LED housing unit is described wherein the housing unit will have a chambered section connected to a mounting section. The mounting section will be mountable onto a base, such as a PCB mounting in a light fixture. The chambered section will have a plurality of chambers that have separating walls and each chamber will be able to hold an LED chip and liquid. The housing unit will also have a heat sink within the housing that extends outside of the housing. Electrical conduits will lead to the LED chips within each chamber and will lead to locations outside of the housing. All the positive leads will lead to one side of the housing while the negative leads will lead to the other side of the housing.

6 Claims, 7 Drawing Sheets

LED HOUSING

CROSS-REFERENCE TO RELATED APPLICATIONS

This application relates to and claims priority rights from provisional applications U.S. 61/758674 and U.S. 61/692856 filed on Jan. 30, 2013 and Aug. 24, 2012, the entire disclosures of which are hereby incorporated by reference herein.

BACKGROUND OF THE INVENTION

1. Field of the Invention

This invention relates to a housing for an LED lighting device.

2. Description of the Related Art

LEDs are rapidly becoming a popular source of lighting systems. Using LEDs provide numerous advantages over traditional light bulbs. For example, the size of the LED is dramatically smaller than a typical incandescent bulb, but the luminance of the LED can be just as strong or even greater. Since an LED is a relatively small semiconductor device, lighting fixtures employing these devices will try to optimize the light provided and minimize the space requirements and costs of the device.

LED lighting fixtures have been capable of producing many different lighting effects from incandescent light to fluorescent light and reproducing nearly every color in the spectrum. In producing white light, an LED device will typically comprise of a blue emitting LED that has been covered by a phosphor. The LED will typically be placed in a housing that will have the LED on the bottom with the phosphor coating above the LED. The housing needs to be able to contain the phosphor at the very least while it dries. In addition, electrical conduits must be able to electrically connect the LED to the power supply.

Typically, LEDs will be physically located together to create a lighting solution. Color combinations such as red, green and blue LEDs have been grouped together to effect the different colors in the color scheme. It is advantageous to have these combinations of LEDs placed as close together as possible and minimizing the space requirements on the PCB mounting board.

LEDs can also generate heat that needs to be regulated to ensure that the LED will not burn out. In addition, controlling the temperature of the LED junction point will help to sustain maximum light, life and color consistency. Rapid fluctuations in the temperature can have undesirable effects in an LED lighting as the color and the luminance of light emitted by the LED will also vary greatly with the temperature fluctuations and will be noticed in a lighting fixture that uses LEDs. Thus, these systems utilize a cooling system to regulate the heat generated by the LED. As more powerful (higher wattage) LEDs are being used, the cooling system needs to be efficient to prevent the above mentioned problems.

SUMMARY OF THE INVENTION

The above objects of the invention and advantages are achieved by having a LED housing that creates a common housing with separate chambers for at least three separate LED chips. Each chamber will have a separation walls that will be able to contain phosphor within that chamber, if necessary. Each chamber will be equally spaced from each other to effectively blend the light from each LED chip.

The housing will have electrical conduits that run through the housing to each LED chip contained therein. The electrical conduits will be advantageously placed on the outside of the housing to efficiently aid in mounting the housing on a PCB substrate. The electrical conduits will be situated such that all positive conduits will be on the same side as each other while the negative conduits will be on the same side as each other.

The housing will also have a heat sink feature built into the housing that will aid in controlling the temperature of the LED chips. The heat sink feature will be a metallic/copper plate that is closely situated to the LED chips. The copper plate is situated near to all three chips such that the same plating can be used to maintain the temperature of the chips at the same time.

DETAILED DESCRIPTION OF THE EMBODIMENTS

Figure 1:
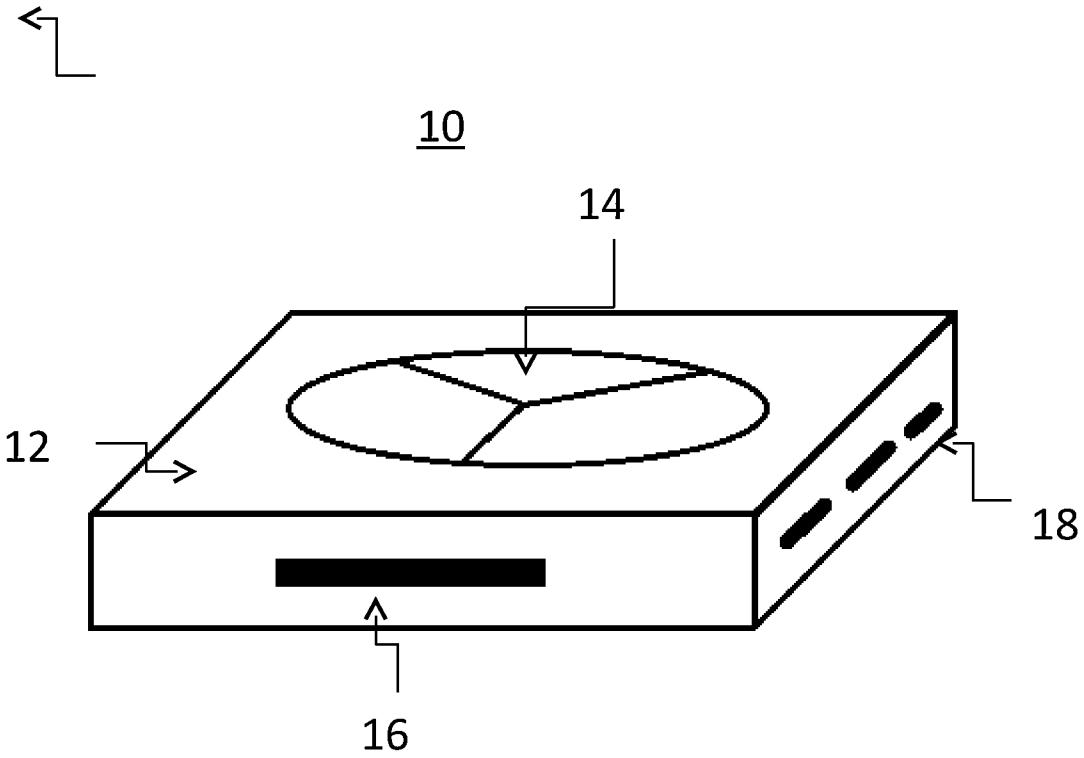
FIG. 1 depicts a perspective view of the housing in accordance with one embodiment of the present invention.

For the purposes of understanding the invention, reference will now be made to the embodiments illustrated in the drawings. It will be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, one embodiment of the invented LED housing is depicted. Housing 10 is composed of mounting section 12 and chamber section 14. Chamber section 14 is composed of a cylindrical hole that is in the center of housing 10. Chamber section 14 is composed of three separate chambers. Each chamber has walls that divide each chamber. These walls are rigid walls and are capable of containing a liquid within the chamber and keeping it separate from the other chambers. This allows several different color temperature mixes of phosphor to be used in the same housing to create different colors of white.

Mounting section 12 will be used to mount the housing on a PCB along with other LED housings. As shown in FIG. 1, housing 10 is shaped as a square, but can be other shapes to accommodate mounting the housing in an LED lighting fixture. Mounting section 12 will also house leads to heat sink 16 and electrical contacts 18. Both chamber section 14 and mounting section 12 of housing 10 can be composed of the same material as long as it achieves the purposes outlined above.

Figure 2:
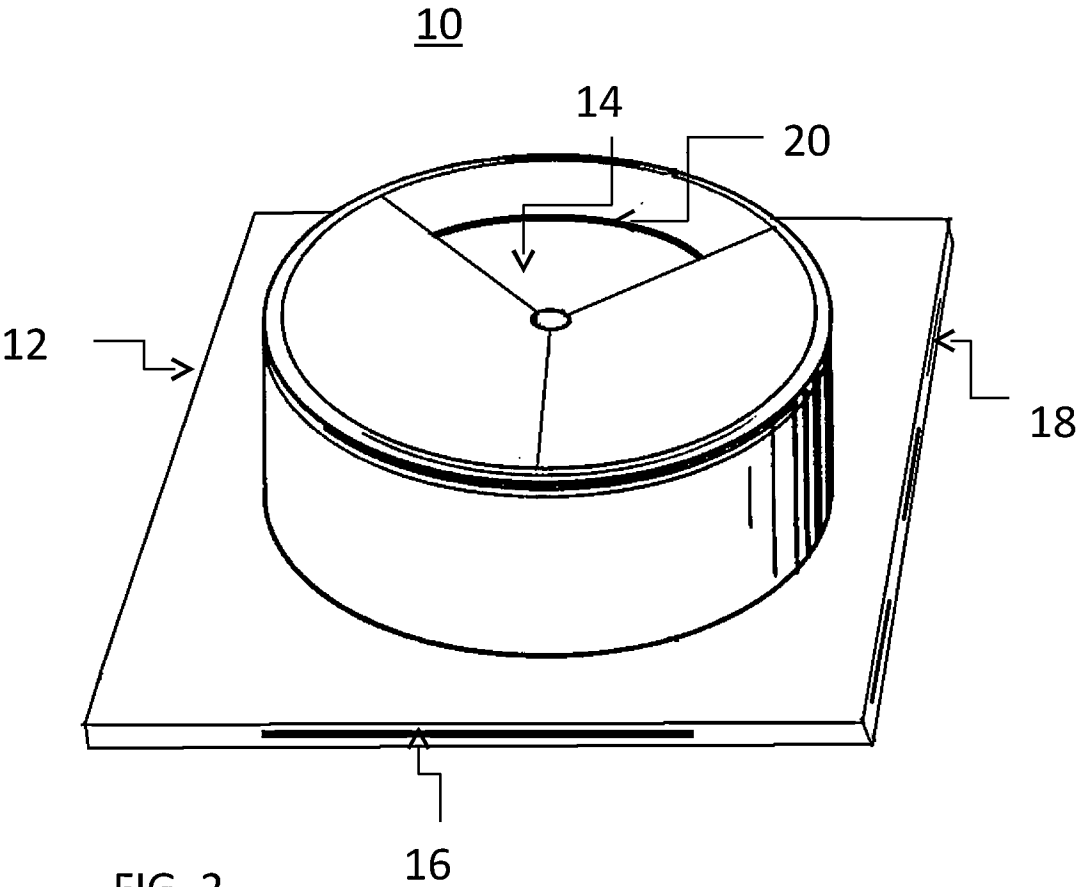
FIG. 2 depicts a perspective view of the housing in accordance with another embodiment of the present invention.

FIG. 2 depicts an alternate embodiment of housing 10. Chamber section 14 sits atop mounting section 12 instead of being surrounded by mounting section. Chamber section 14 is cylindrical in shape, but the walls of each chamber do not have to be directly perpendicular to base mounting section. The walls of each chamber can be slanted slightly inward or outward to accommodate different concerns. One concern is the ability to hold the phosphor or other suitable liquids inside. In addition, the walls of each chamber can contain ridges 20 that act to hold the phosphor in place when it dries. This will allow it to adhere to the walls of the chambers to make for a stable and even phosphor placement and color mixing. In addition, a lens can be easily snapped onto the top of the cylindrical section to allow different beam angles and LED light distribution. Any other shapes can be used for the chamber according to the need of the lighting fixtures.

Figure 3:
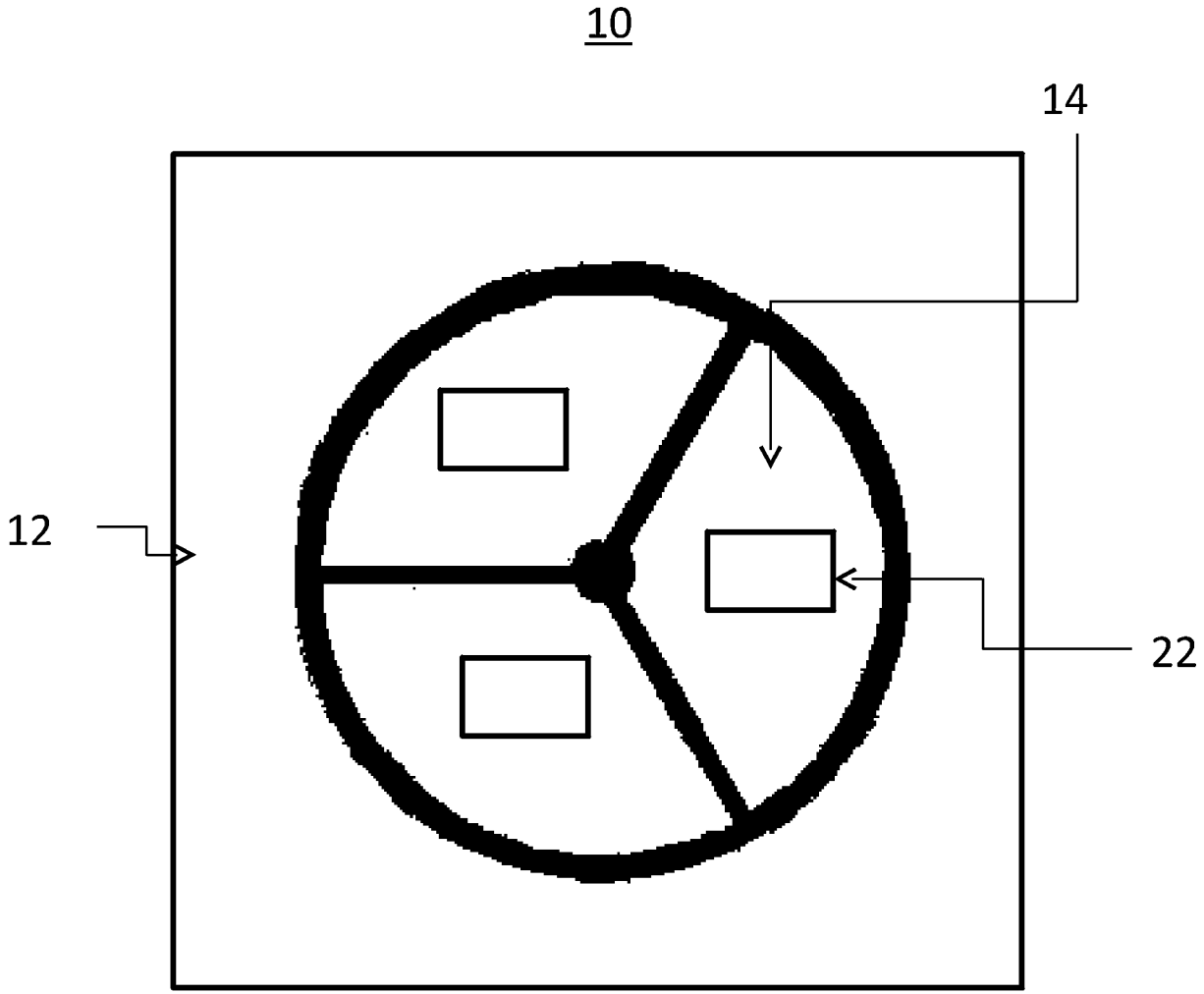
FIG. 3 depicts a top view of the housing in accordance with one embodiment of the present invention.
Figure 4:
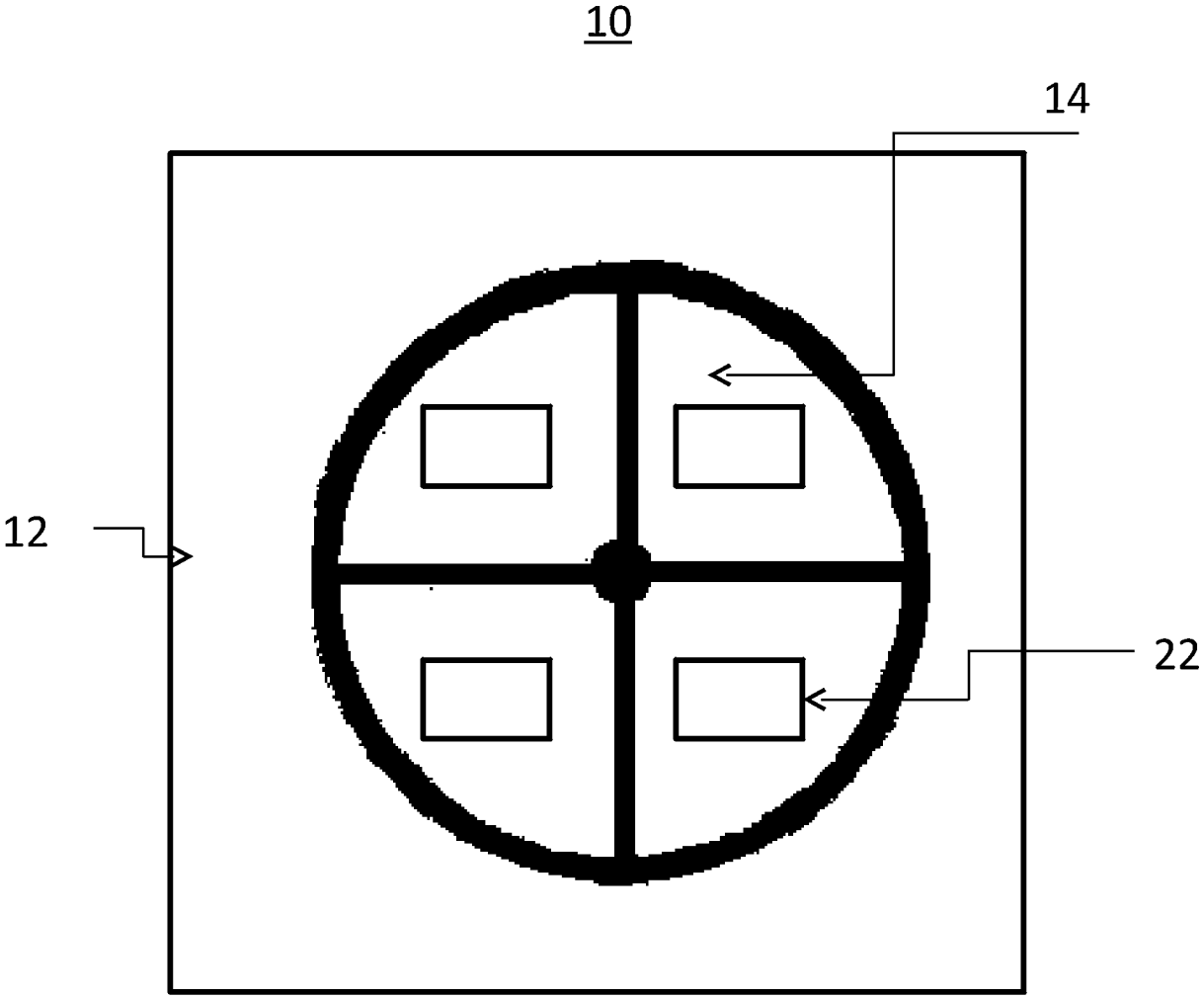
FIG. 4 depicts a top view of the housing in accordance with another embodiment of the present invention.

FIG. 3 depicts a top view of the housing. Chambers section 14 contain LED chips 22 within each chamber. Different combinations of LED chips are intended to be used within each chamber. Ideally, two of the chambers will have different color temperatures of white while the third chamber will have a colored LED such as red or amber. This combination has been found to enable the lighting fixture to simulate different types of natural lighting. For example, incandescent lighting can be simulated with these combinations of LED chips. For the two chambers that contain white LED chip combinations, the chamber will be filled with phosphor along with a blue LED chip. As can be seen, the placement of each chip is approximately equi-distant from the other two LED chips. This allows the lighting mixing to be even amongst the three LED chips. FIG. 4 shows an alternate embodiment wherein four chambers are implemented. As shown, each LED chip is situated to be equidistant from the other chips.

Figure 5:
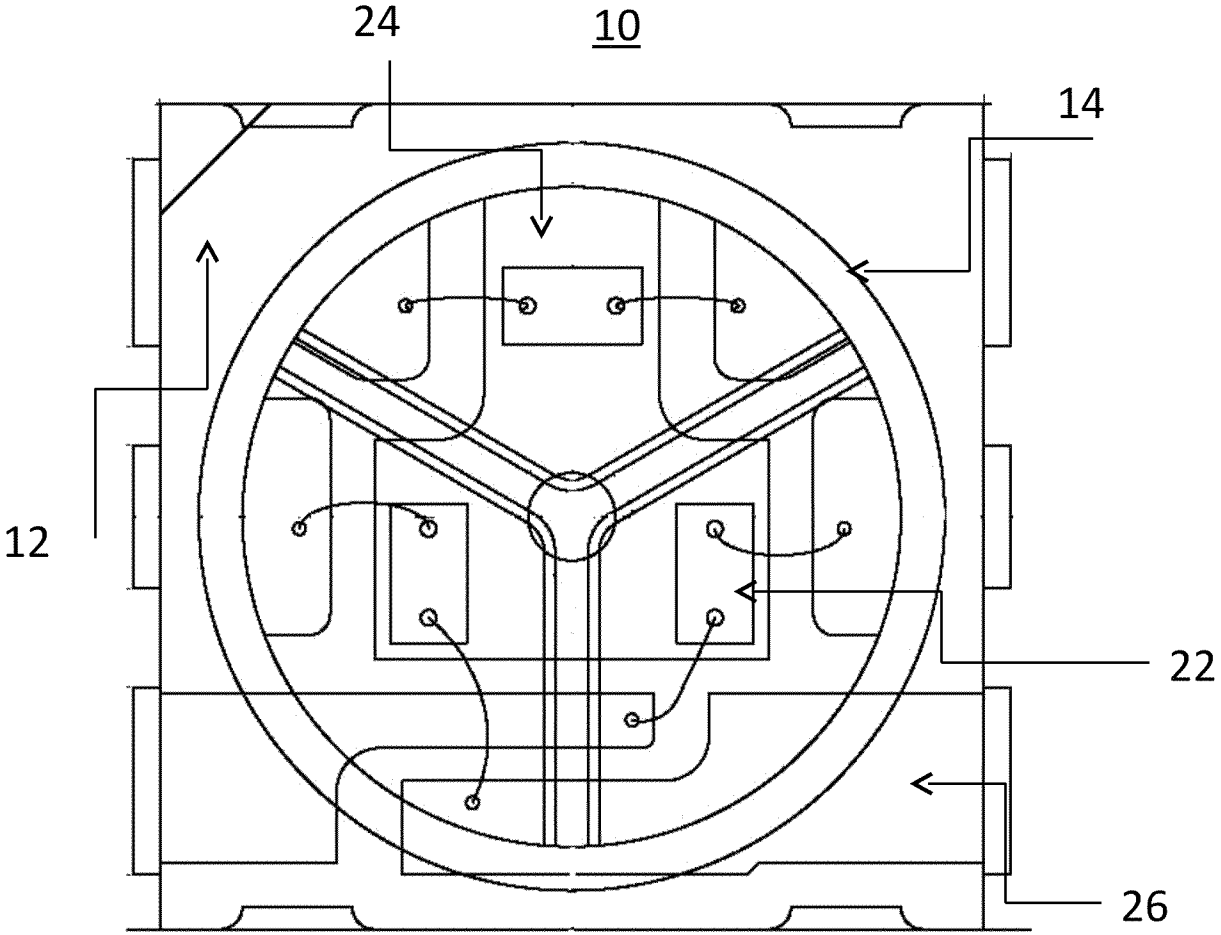
FIG. 5 depicts a plan view of the various components of the invented housing.
Figure 6:
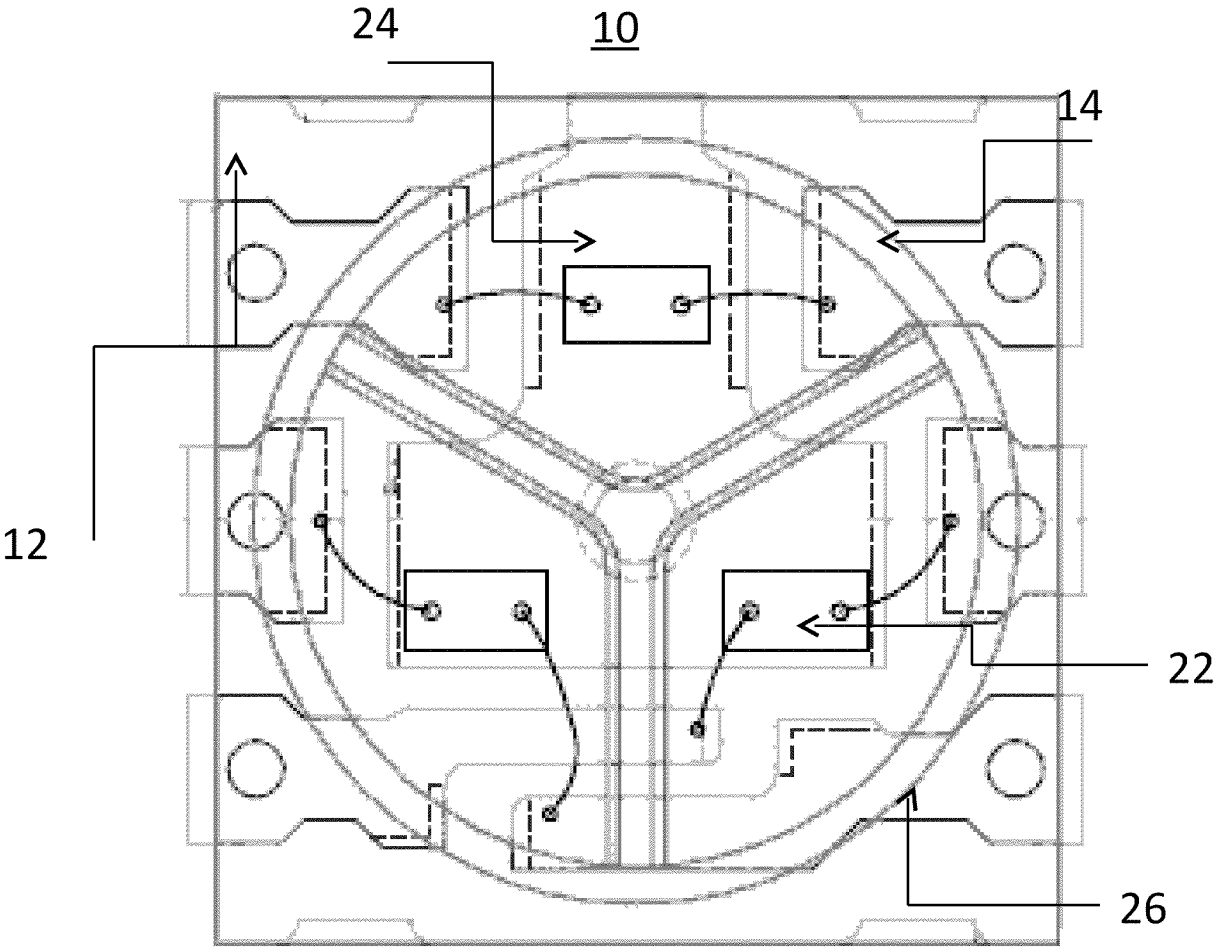
FIG. 6 depicts a plan view of the various components of the invented housing.

FIGS. 5 and 6 depict plan views of the housing showing the heat sink components and the electrical conduits. Cylindrical chamber section 14 is shown with three LED chips 22 contained therein each one. Each LED chip will be directly above heat sink component 24. Heat sink component can be a plate that goes directly from the LED to the PCB or other cooling system. Ideally, the plate will be metallic or other material that transfers heat quickly. For example, copper works effectively as a quick heat transfer unit. Although placed above heat sink component 24, each LED chip will not be in electrical contact with heat sink component 24. Having this heat sink as part of the housing 10 allows the heat sink to be the closest to the chips. Other heat sinks rest on the bottom of the housing and the heat transfer characteristics are not that efficient. In addition, having the heat sink lead to outside of the housing allows other proactive heat sinks to be utilized. In addition, as the heat sink is common to all three LED chips, it provides the ability to control the heat characteristics of all three chips at the same time. With an improved heat sinking feature, more powerful chips can be used as the additional heat that they generate can be efficiently monitored. For example, chips that use 1.5 watts and higher can be used.

Each LED is electrically connected to electrical conduits 26. Electrical conduits 26 lead to the sides of housing 10 and provide electrical contacts for the LED chips. Each of the three LEDs will have an negative and positive electrical contacts. As configured in the housing, all of the negative electrical leads will lead to the electrical conduits to the left of the housing while all of the positive electrical leads will lead to the right side of the housing. By coordinating the electrical leads to having the same type of electrical leads come out of the same side of the housing, the PCB design is simplified and the cost of the PCB design is reduced.

Figure 7:
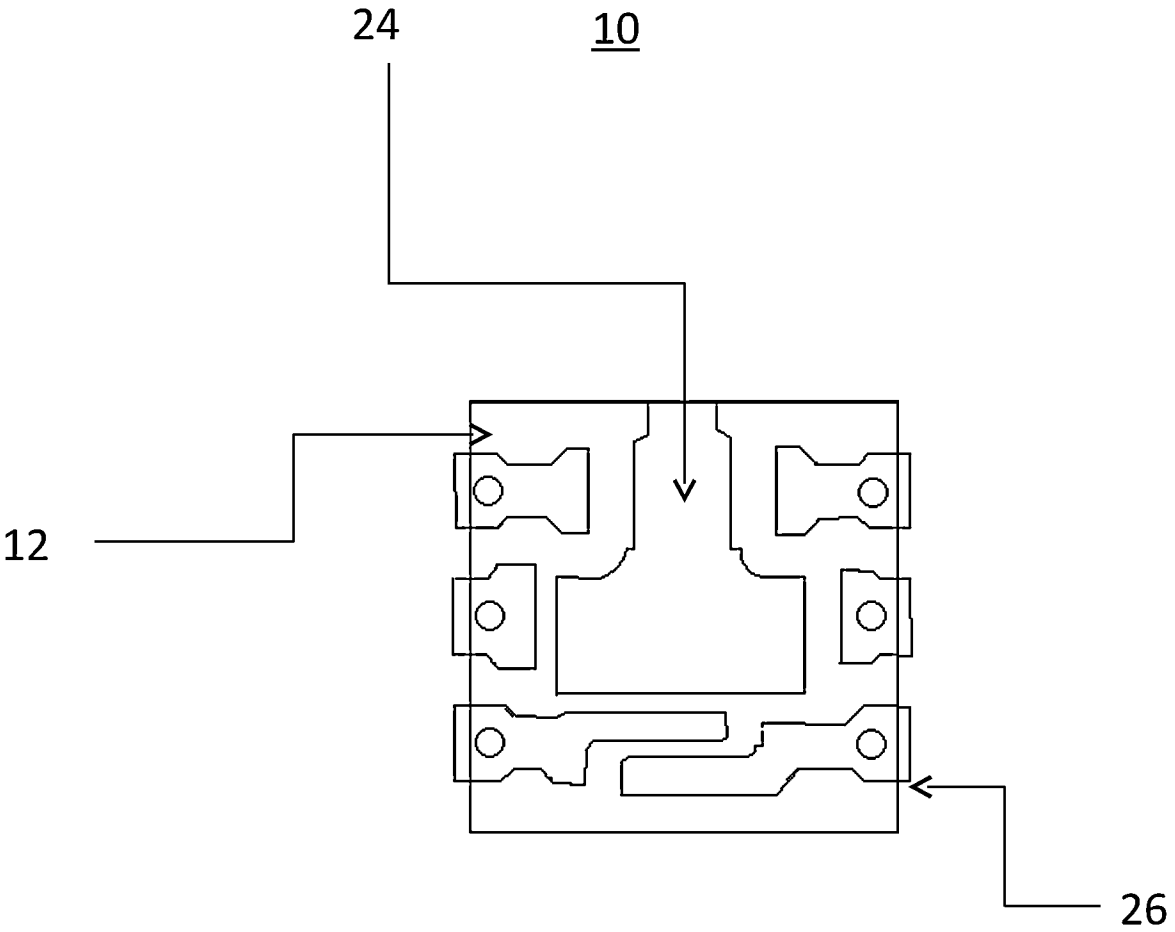
FIG. 7 depicts a plan view of the various components including the heat sink and the conduits of the invented housing.

FIG. 7 is a plan view that just shows the level containing the electrical conduits and the heat sink. As can be seen each of the heat sink component, the positive and negative electrical conduits are not connected to each other. Moreover, each element exist on the same plane of the housing without being electrically connected to each other. Doing this allows a smaller housing to be utilized as two different layers do not have to be used to accommodate each layer.

What is claimed is:

1. An LED housing comprising:

a body composed of a first material and having a first side and a second side; said first and second sides not being on the same side of the body; said body comprising of a chamber that is capable of holding an LED chip and a liquid; wherein said chamber is divided into a plurality of sections; each of said plurality of sections being capable of holding an LED chip and a liquid separate from each other section;

a heat sink composed of a second material; said heat sink being located within said body and underneath the LED chips contained within said chamber;

at least two electrical conduits composed of a third material; said electrical conduits being located within said body and underneath the LED chips and capable of being electrically connected to the LED chips that are held within said chamber; wherein one of said at least two electrical conduits extends out of said first side and the other conduit extends out of said second side; and wherein the heat sink and the electrical conduits that are located underneath the LED chips are located on the same level plane as each other within said body.

2. The LED housing as recited in claim 1 wherein said liquid is a phosphor.

3. The LED housing as recited in claim 1 wherein said heat sink physically contacts each LED held in said chamber.

4. The LED housing as recited in claim 1 wherein said first material, second material and third material are different materials.

5. The LED housing as recited in claim 1 wherein the plurality of sections comprise three sections and each section contain LED chips and liquid such that one section emits a colored light and the other two sections emit white light.

6. The LED housing as recited in claim 1 wherein said body has a third side that is different from said first and second sides; said heat sink being capable of physically contacting a substrate outside of said body on said third side.

* * * * *